US012178340B2

(12) United States Patent
Davidson

(10) Patent No.: US 12,178,340 B2
(45) Date of Patent: Dec. 31, 2024

(54) LIQUID CONTROL TOOL

(71) Applicant: Jon Bruce Davidson, Glendale, CA (US)

(72) Inventor: Jon Bruce Davidson, Glendale, CA (US)

( * ) Notice: Subject to any disclaimer, the term of this patent is extended or adjusted under 35 U.S.C. 154(b) by 339 days.

(21) Appl. No.: 17/712,496

(22) Filed: Apr. 4, 2022

(65) Prior Publication Data

US 2023/0034432 A1 Feb. 2, 2023

Related U.S. Application Data

(60) Provisional application No. 63/203,868, filed on Aug. 2, 2021.

(51) Int. Cl.
*A47G 21/04* (2006.01)

(52) U.S. Cl.
CPC ..... *A47G 21/04* (2013.01)

(58) Field of Classification Search
CPC .... A47G 21/004; A47G 21/04; A47G 21/181; A47G 2400/062; A47J 43/28; A47J 43/281; A47J 43/282; A61J 7/0023
USPC ..... 30/125, 141, 324–328
See application file for complete search history.

(56) References Cited

U.S. PATENT DOCUMENTS 674,446 A * 5/1901 Marx ..... A47G 21/181 30/141
763,593 A * 6/1904 Canclini ..... A47G 21/181 30/324
1,155,802 A * 10/1915 Dennis ..... A47G 21/004 30/125
1,317,691 A * 10/1919 Fields ..... A47G 21/004 30/125
1,323,619 A * 12/1919 Curtin ..... A47G 21/04 30/324
1,490,785 A * 4/1924 Purnell ..... A47G 21/181 30/141

(Continued)

FOREIGN PATENT DOCUMENTS

GB 2083341 A * 3/1982 ..... A47G 21/181
WO WO 8002875 A1 * 12/1980 ..... A61J 7/00

OTHER PUBLICATIONS

Good Mythical Morning. "We Invented Never Before Seen Products." YouTube.com, Sep. 21, 2021, 1 page, [Online] [Retrieved Oct. 25, 2022], Retrieved from the Internet <URL:https://www.youtube.com/watch?v=8Mbba9T4KUQ>.

*Primary Examiner* — Jason Daniel Prone
(74) *Attorney, Agent, or Firm* — Fenwick & West LLP

(57) ABSTRACT

A liquid control tool enables users to control the timing and amount of liquid to be consumed. The liquid control tool includes a handle and a head attached to the handle. The handle has a cavity (e.g., for storing liquid). The head has a concave surface defining a bowl. The liquid control tool also has two one-way valves to control the flow of liquid into and out of the cavity. The first one-way valve allows fluid to transfer, through a first opening in the bowl, from an external environment into the cavity. The second one-way valve allows fluid to transfer, through a second opening in the bowl, from the cavity into the bowl. A user can use the liquid control tool to hold and combine their food with a liquid when the user squeezes the handle and is ready to eat the food.

15 Claims, 4 Drawing Sheets

(56) References Cited

U.S. PATENT DOCUMENTS 1,857,712 A * 5/1932 De Martini, Jr. ..... A47G 21/04 30/141
2,252,119 A * 8/1941 Edmonds ..... A61J 7/0023 30/141
2,255,052 A * 9/1941 Green ..... A47J 43/281 30/324
2,453,525 A * 11/1948 McNeill ..... A61J 7/0023 30/141
2,698,996 A * 1/1955 Hickerson ..... A61J 7/0023 30/324
2,859,515 A * 11/1958 Kinman ..... A47G 21/181 30/324
3,014,277 A * 12/1961 Geckler ..... A47G 21/04 30/324
3,116,152 A * 12/1963 Smith ..... A47G 21/004 426/115
3,259,132 A * 7/1966 Katter ..... A47G 21/04 30/141
3,287,806 A * 11/1966 Kellerman ..... A47G 21/004 206/229
3,410,457 A * 11/1968 Brown ..... A47G 21/004 222/215
3,473,221 A * 10/1969 Flanders ..... A47G 21/04 30/141
3,612,358 A * 10/1971 Massa ..... A61J 7/0023 D24/116
4,192,360 A * 3/1980 Rodriquez ..... A61J 7/0023 401/128
4,724,615 A * 2/1988 Mackles ..... A61J 7/0023 30/179
4,830,222 A * 5/1989 Read ..... A47G 21/004 426/115
4,880,409 A * 11/1989 Bergkvist ..... A61J 7/0023 D24/116
4,888,188 A * 12/1989 Castner, Sr. ..... A47G 21/004 222/146.2
4,957,226 A * 9/1990 Pacia ..... A47G 21/04 401/266
4,986,433 A * 1/1991 Davis ..... A47G 19/02 220/23.8
5,038,476 A * 8/1991 McCrea ..... A47G 21/181 30/141
5,137,183 A * 8/1992 Mikulec ..... A61J 7/0023 222/525
5,305,928 A * 4/1994 Verdaguer ..... B65D 51/246 30/125
5,377,879 A * 1/1995 Isaacs ..... A61J 7/0023 604/218
5,462,101 A * 10/1995 Mouchmouchian .. A61J 7/0023 141/18
5,491,895 A * 2/1996 Lee ..... A61J 7/0023 30/141
5,669,143 A * 9/1997 Wu ..... A47G 21/02 30/324
5,682,931 A * 11/1997 Mouchmouchian .. A61J 7/0023 222/528
5,727,321 A * 3/1998 Lewis ..... A47G 21/181 30/141
5,873,167 A * 2/1999 Mason ..... A47G 21/004 30/324
5,881,926 A * 3/1999 Ross ..... A61J 7/0023 141/18
5,890,630 A * 4/1999 Lobdell ..... A47G 21/004 222/192
5,894,959 A * 4/1999 Sigurlidason ..... A47G 21/004 222/192
5,975,305 A * 11/1999 Barger ..... A61J 7/0023 30/141
6,102,254 A * 8/2000 Ross ..... A61J 7/0023 222/153.06
6,279,233 B1 * 8/2001 Cameron ..... A61J 7/0023 30/324
6,675,482 B1 * 1/2004 Gilbert, Jr. ..... A61J 7/0023 30/141
6,722,043 B2 * 4/2004 Teng ..... A47J 43/285 30/324
6,928,870 B1 * 8/2005 Liebowitz ..... A47G 21/004 222/191
7,047,648 B1 * 5/2006 LeBel ..... A47G 21/181 30/141
7,210,600 B1 * 5/2007 Delio, Jr. ..... A47G 21/04 222/93
7,975,386 B1 * 7/2011 Halvorson ..... A47G 21/004 30/141
8,020,303 B1 * 9/2011 Marsh ..... A47G 21/004 30/324
8,038,037 B2 * 10/2011 deVirag ..... A47G 21/004 30/141
8,091,242 B2 * 1/2012 Teys ..... A47G 21/004 30/324
8,607,459 B2 * 12/2013 Geissler ..... A47G 21/004 30/141
9,635,965 B2 * 5/2017 Murray ..... A47G 21/004
9,888,797 B2 * 2/2018 Edry ..... A47G 21/004
10,039,399 B2 * 8/2018 Cunningham ..... A47G 21/181
2002/0148852 A1 * 10/2002 Schultz ..... A61J 7/0023 222/78
2004/0006874 A1 * 1/2004 Kamm ..... A47G 21/004 30/141
2005/0244549 A1 * 11/2005 Ling ..... A47G 21/004 426/115
2010/0147885 A1 * 6/2010 Braxton ..... A61J 7/0023 30/326
2011/0197453 A1 * 8/2011 Hultgreen ..... A47J 43/28 30/141
2012/0066911 A1 * 3/2012 Hicks ..... A47G 21/04 30/141
2013/0306647 A1 * 11/2013 Sachdev ..... A47G 21/004 220/574.1
2014/0245618 A1 * 9/2014 Wood ..... A47G 21/04 30/324
2016/0120346 A1 * 5/2016 Callahan ..... B65D 77/245 222/1
2019/0133357 A1 * 5/2019 Stone ..... A61J 7/0023
2020/0367679 A1 * 11/2020 Leffler ..... A47G 21/04
2022/0225806 A1 * 7/2022 Haberman ..... A47G 21/04
2023/0389737 A1 * 12/2023 Rodriguez ..... B65D 83/0055
2024/0074604 A1 * 3/2024 Gougian ..... A47G 21/181

* cited by examiner

LIQUID CONTROL TOOL

CROSS REFERENCE TO RELATED APPLICATIONS

This application claims the benefit of U.S. Provisional Application No. 63/203,868, filed Aug. 2, 2021, which is incorporated by reference in its entirety.

TECHNICAL FIELD

The disclosure generally relates to a tool for controlling liquid and in particular, to a tool with a suction mechanism to transport liquid for consumption.

BACKGROUND

Foods like cereal and noodles can be served with a liquid for consumption. However, once the food and liquid are together, it's difficult to control the timing of how the food absorbs the liquid. For example, a user may need to step away from their food before they can finish the meal. When they return, the liquid could be absorbed into their food to an undesirable extent (e.g., soggy cereal or mushy noodles). While a user can try to re-separate the food from the liquid, this is inconvenient for the user and negatively impacts the eating experience. Conventional spoons offer no mechanism for preventing over-absorption of liquids into food. Users of conventional spoons are faced with the heartbreak of eating soggy cereal and mushy noodles when they are interrupted and taken away from their meals before they have a chance to finish them.

SUMMARY

A liquid control tool is used to transport liquid for consumption. The liquid control tool enables users to control the timing and amount of liquid to be consumed. The tool's suction mechanism and storage container enable a user to transport liquid into the storage container and expel the liquid for consumption when the user is ready to consume the liquid (e.g., with crisp cereal or cooked noodles). The suction mechanism includes two one-way valves that control the flow of liquid into and out of the tool. For example, a user can apply a force to the handle of the tool to expel liquid or air from the handle of the tool, and relieve the handle of the applied force to create a suction effect that can transport liquid or air into the handle. A user can use the liquid control tool to hold their food and combine the food with a liquid whenever the user squeezes the handle and is ready to eat the food. Thus, the user can avoid soggy foods.

In one embodiment, the liquid control tool includes a handle and a head attached to the handle. The handle has a cavity (e.g., for storing liquid). The head has a concave surface defining a bowl. The liquid control tool also has two one-way valves to control the flow of liquid into and out of the cavity. The first one-way valve is configured to allow fluid to transfer, through a first opening in the bowl, from an external environment into the cavity. The second one-way valve is configured to allow fluid to transfer, through a second opening in the bowl, from the cavity into the bowl.

The head of the liquid control tool may also have a convex surface. The first opening can be located in the convex surface while the second opening can be located in the concave surface. The head can have two channels for the liquid to flow through. A first channel in the head can couple the first opening to the first one-way valve and a second channel can couple the second opening to the second one-way valve. The head may include two receptacles to couple the two one-way valves, respectively, to the head.

The liquid control tool may also include a backflow tube that is coupled to the second one-way valve. The backflow tube can enable an initial amount of fluid to be stored at the cavity before the liquid is transferred from the second one-way valve into the bowl. The backflow tube can be coupled to the second one-way valve using a fitting. The backflow tube can be curved (e.g., curved towards a wall of the cavity within the head). The handle of the liquid control tool may be composed of a non-opaque material. The handle may be composed of a flexible material.

The head of the liquid control tool may include an attachment interface that attaches the head to the handle. The attachment interface can include a ring-shaped cavity that has a width and a depth to receive a rim of the handle during attachment. The opening of the cavity can be sealed by the attachment interface when the head is attached to the handle. The width of the rim of the handle can be equivalent to the width of the handle (e.g., a consistent width along the length of the handle from distal to proximate ends of the handle). The depth of the ring-shaped cavity can be at least one millimeter and less than a quarter of a length of the handle. The first one-way valve and the second one-way valve may be coupled to the attachment interface and encircled by the ring-shaped cavity.

BRIEF DESCRIPTION OF DRAWINGS

The disclosed embodiments have other advantages and features which will be more readily apparent from the detailed description, the appended claims, and the accompanying figures (or drawings). A brief introduction of the figures is below.

DETAILED DESCRIPTION

The Figures (FIGS.) and the following description describe certain embodiments by way of illustration only. One skilled in the art will readily recognize from the following description that alternative embodiments of the structures and methods may be employed without departing from the principles described. Throughout the following description, the term "proximal" refers to the end of the apparatus which is closer to the user's hand when being used as intended and described, and the term "distal" refers to the end of the apparatus which is further away from the user's hand when being used as intended and described.

Liquid Control Tool Structure

Figure 1A:
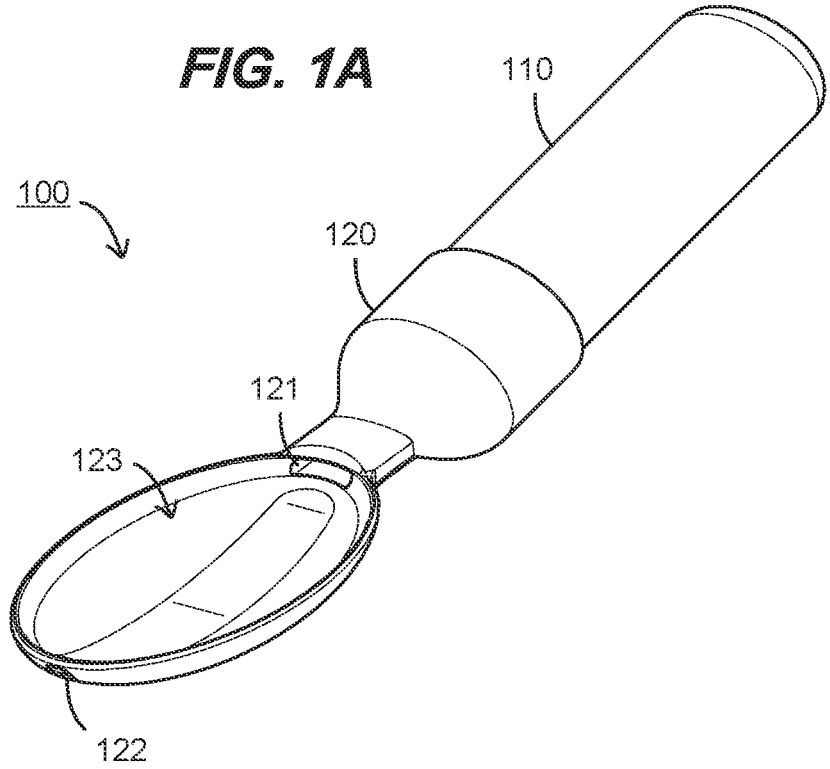
FIG. 1A shows an isometric view of a liquid control tool, in accordance with one embodiment.
Figure 1B:
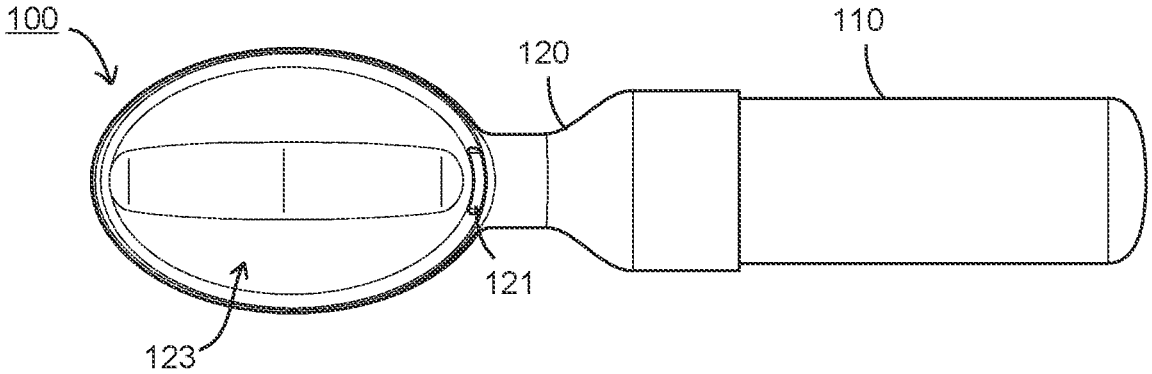
FIG. 1B shows a top view of a liquid control tool, in accordance with one embodiment.
Figure 1C:
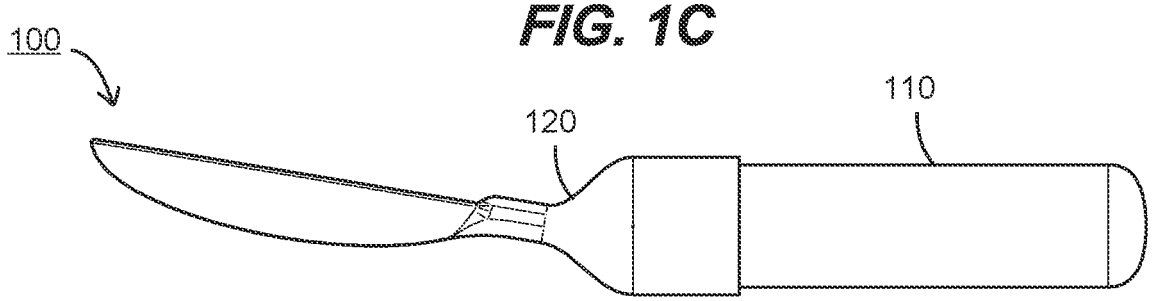
FIG. 1C shows a side view of a liquid control tool, in accordance with one embodiment.
Figure 1D:
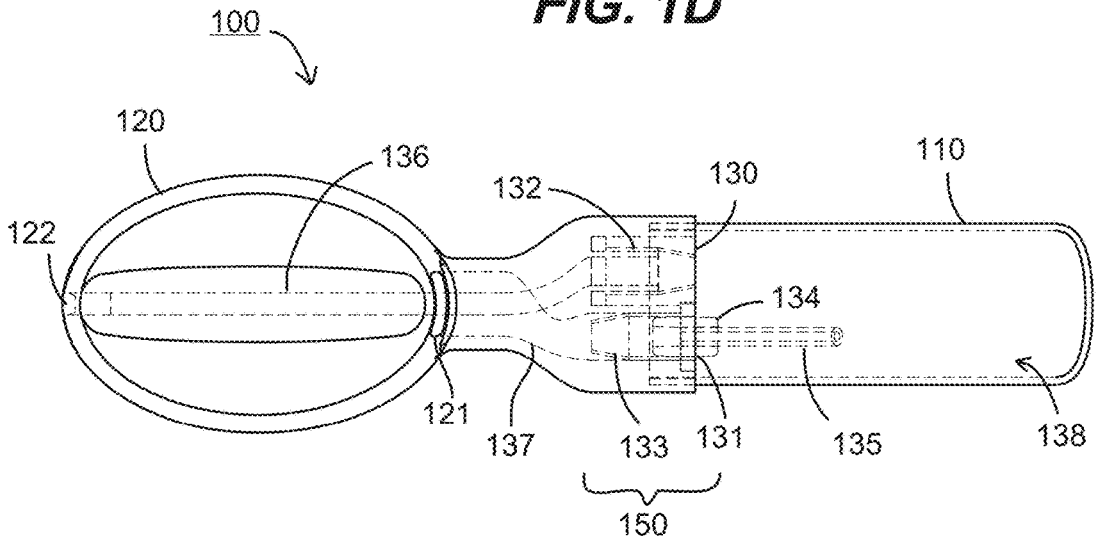
FIG. 1D shows an interior structure of a liquid control tool from a top view of the tool, in accordance with one embodiment.
Figure 1E:
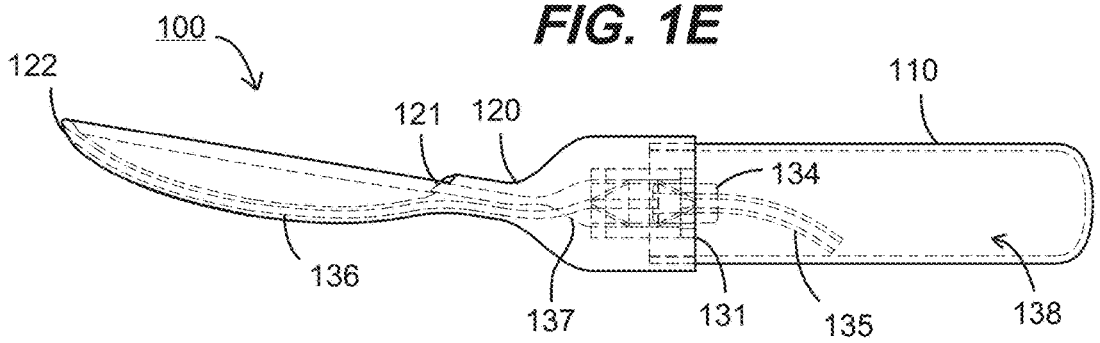
FIG. 1E shows an interior structure of a liquid control tool from a side view of the tool, in accordance with one embodiment.
Figure 1F:
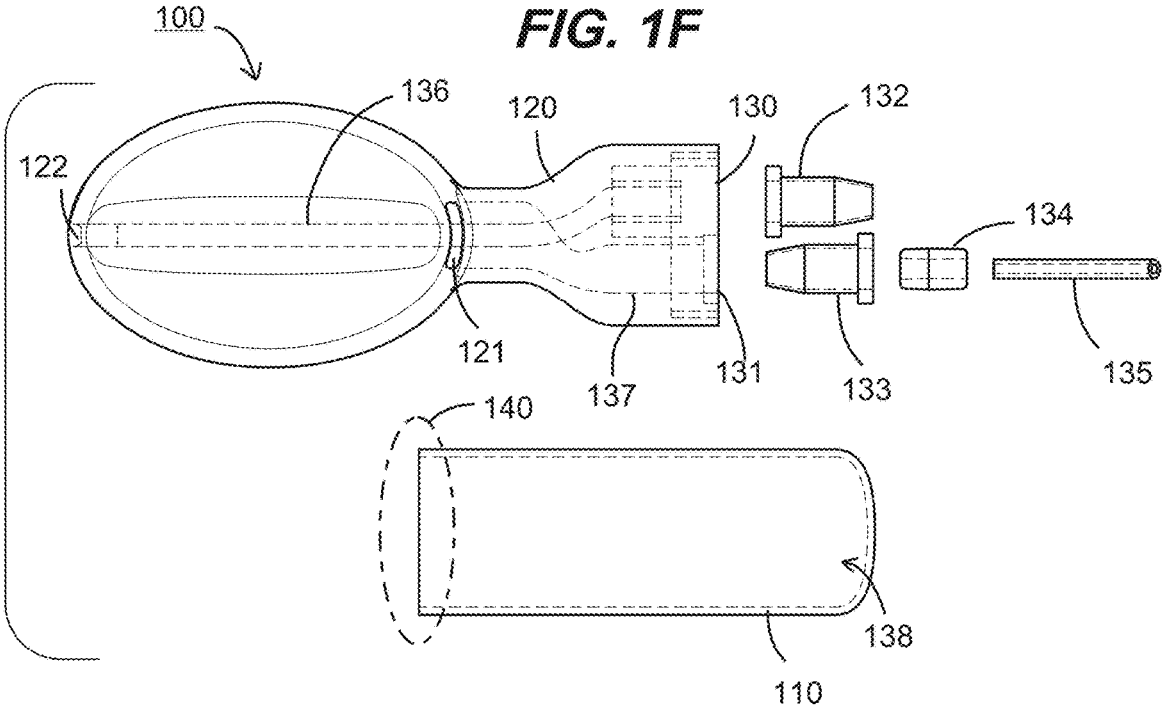
FIG. 1F shows an exploded view of a liquid control tool, in accordance with one embodiment.
Figure 1G:
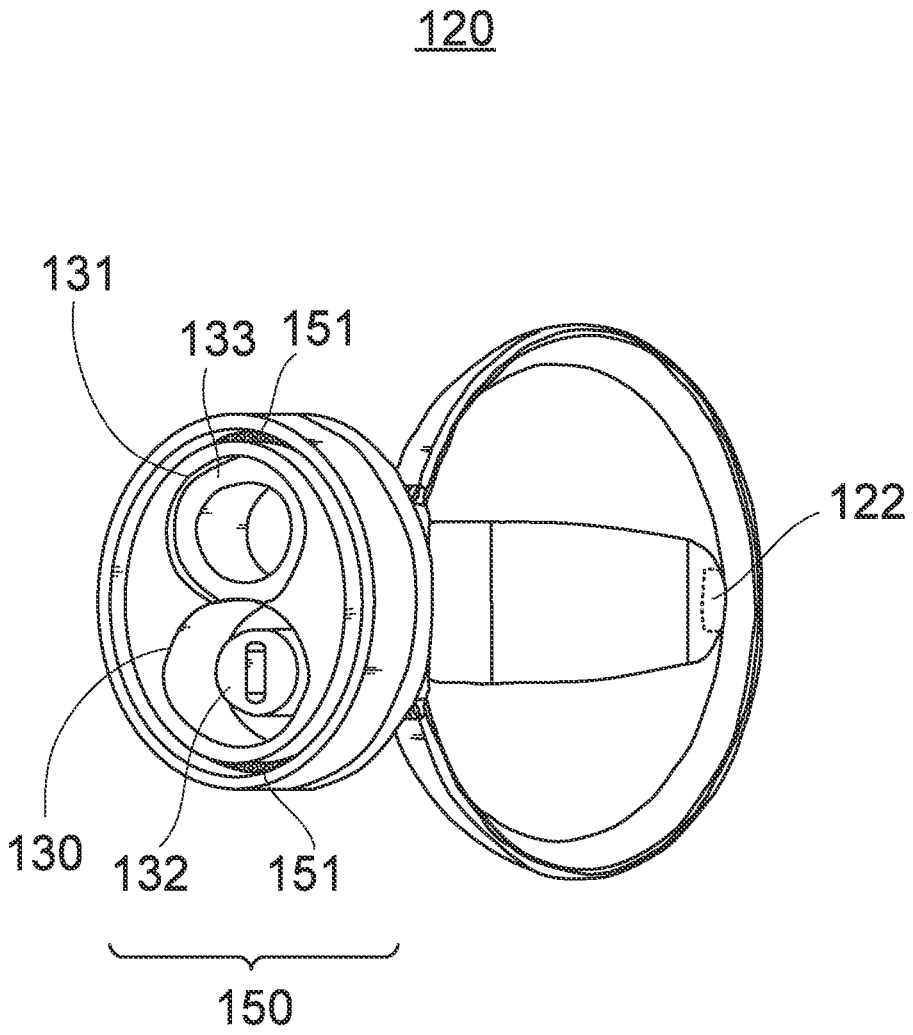
FIG. 1G shows an attachment interface of a liquid control tool, in accordance with one embodiment.

FIGS. 1A-1G show the structure of an embodiment of a liquid control tool 100 through various views. In the embodiment shown, the liquid control tool 100 includes a handle 110 and a head 120. FIGS. 1A-1C show the external features of the liquid control tool 100. FIG. 1A shows an isometric view of the liquid control tool 100. FIG. 1B shows a top view of the liquid control tool 100. FIG. 1C shows a side view of the liquid control tool 100. FIGS. 1D-1F show the internal features of the liquid control tool. FIG. 1D shows the interior structure of the liquid control tool 100 from the top view as presented in FIG. 1B. FIG. 1E shows the interior structure of the liquid control tool 100 from the side view as presented in FIG. 1C. FIG. 1F shows an exploded view of the liquid control tool 100. FIG. 1G shows an attachment interface of the liquid control tool 100.

The liquid control tool 100 may be a spoon for eating or drinking food. In particular, the control of liquid enabled by the tool 100 may allow a user to control the timing and amount of liquid that is consumed. This control can be beneficial for consuming a food that is eaten with a liquid (e.g., cereal or a soup-based noodle). An additional benefit is consuming such a food while in transit (e.g., while the user is commuting from home to work). In one example, a user can use the liquid control tool 100 to consume cereal while walking to work. If the user pours milk into a conventional container (e.g., a simple plastic bowl with lid) with the cereal, the cereal will absorb the milk during the user's commute. With only a conventional container, the user does not have control of the milk's absorption and may be the victim of undesirably soggy cereal. However, using the tool 100 described herein, the user can consume crisp cereal with milk in one bite at the user's convenience.

Before leaving home, a user may input milk into the handle 110 and into a separate bottle from which the user can obtain milk from while commuting. The user can control the output of milk from the handle 110 while eating their cereal. The user may have a separate container holding dry cereal and use the head 120 to scoop the cereal into the bowl 123. When the user wants to have a bite of cereal with milk, the user may squeeze the milk out of the handle 110 and into the bowl 123. The milk is maintained in the handle 110 when the user is not squeezing the handle 110. If the amount of milk is running low, the user can add more milk into the handle 110 by submerging an opening 122 of the head 120 into milk and releasing an applied force from the handle 110. The user can also adjust the amount of milk they want with their spoonful of cereal according to an amount of force applied to the handle 110. Accordingly, the user can conveniently eat crisp cereal with milk on-the-go with the liquid control tool 100. The structure of the liquid control tool 100 that enables the benefits described above are described in the following paragraphs.

The handle 110 is located at a proximal end of the liquid control tool 100. The handle 110 stores liquid. For example, the handle 110 includes a cavity 138 to hold liquid that is transferred (e.g., poured or suctioned) into the cavity 138 from outside the tool 100. Examples of liquid that can be stored in the cavity 138 include milk, a broth, or any suitable liquid that can be consumed using a spoon. The cavity 138 can be substantially the size of the handle 110. For example, the handle 110 may have a thickness of 1-2 millimeters (mm) around the entirety of the handle 110, and the hollow inside of the handle 110 is the cavity 138. The handle 110 includes an opening 140 for the liquid to enter the cavity 138. A rim of the handle 110 surrounds the opening 140. The width of the rim may be equal to the width of the handle 110. The rim couples to the attachment interface to connect the head 120 to the handle 110. In some embodiments, the handle 110 can store liquid using a suction bulb located within the handle 110. The examples described for holding liquid in the handle 110 are non-limiting and any suitable compartment is configured to expel its contents in response to being compressed and intake contents in response to being relieved of force is suitable for use in the tool 100 described.

The handle 110 can be partially or fully composed of a non-opaque material (e.g., a transparent or semi-transparent material). For example, the handle 110 may be composed of a clear and flexible plastic such as acrylic, polystyrene, or polycarbonate. In another example, the handle 110 may be composed of a semi-transparent and flexible plastic such as polypropylene. In some embodiments, the handle 110 can be composed of an opaque and flexible material such as polypropylene. The handle 110 may include a combination of opaque and non-opaque portions. For example, the handle 110 may have a non-opaque window along the length of an otherwise opaque handle, where the user can see an amount of volume within the handle 110 through the non-opaque window. In some embodiments, the handle 110 may be composed of a combination of different materials. For example, the handle 110 may include an inner layer of a flexible plastic to contain liquid, an intermediary layer of a flexible, heat insulating material (e.g., flexible rubber foam or woven fiberglass), and an outer layer of the same or different flexible plastic to contain the intermediary and inner layers. The material of the handle 110 contacting the liquid may be composed of a food safe material.

The handle 110 is sized for holding by a human hand. In one example set of dimensions for the handle 110, the handle 110 may be 5-10 centimeters, or approximately 2-4 inches, in length (e.g., for a child's hand) or 10-15 centimeters, or approximately 4-6 inches, in length (e.g., for an adult's hand). Further in this example, the handle 110 may be cylindrical in shape with a radius between 1-2 centimeters or have a shape of an elliptic cylinder with similar width as the cylindrical shape.

The head 120 is located at a distal end of the liquid control tool 100. The head 120 includes a bowl 123 that holds liquid. The head 120 has a concave surface, which can also be referred to as a top surface. The term "top" is used for convenience and should not require orientation of the liquid control tool. The head 120 has a convex surface, which can also be referred to as a bottom surface. Similarly, the term "bottom" is used for convenience and should not require orientation of the tool. The bowl 123 can be sized to have a diameter of approximately 2-3 centimeters and a thickness of 3-5 millimeters, or any suitable dimension to be inserted into a human mouth.

The head 120 includes a first opening 121 and a second opening 122 to control liquid flow between the inside and outside of the liquid control tool 100. The first opening 121 and the second opening 122 are located at the ends of two channels in the head 120 that enable liquid flow (e.g., one-way liquid flow) between a given opening and a cavity within the handle 110. The openings may be located in different locations than depicted. For example, the opening 121 can be located towards the distal of the liquid control tool 100 while the opening 122 is towards the proximal end of the tool 100 (e.g., located at the bottom surface of the head 120 and towards the center of the length of the head 120). The opening 122 for bringing liquid into the cavity 138 may be located at the bottom surface of the head 120. One benefit of this location includes minimizing the likelihood that liquid from within the bowl 123 is transferred into the cavity 138 (e.g., liquid that was squeezed out of the handle 110 is undesirably moved back into the handle 110). The opening 121 is located at the top surface of the head 120 so that liquid expelled from the cavity 138 enters the bowl 123.

The two channels 136 and 137 in the head 120 enable the liquid flow through the head 120. In response to a user applying a force to the handle, fluid transfers from the cavity 138 through the channel 137, out of opening 121, and into the bowl 123. In response to a user releasing or relieving force from the handle, fluid transfers into the opening 122, through the channel 136, and into the cavity 138. The channel 136 is located beneath the bowl 123. The channel 137 is located wholly or partially above the channel 136. The locations of the channels 136 and 137 relative to one another can be dependent on the locations of receptacles 130 and 131 in the attachment interface 150, the locations of the openings 121 and 122, or a combination thereof.

The one-way valves 132 and 133 located at the end of each of the channels 136 and 137 can enable a fixed direction of liquid flow through each channel. Examples of one-way valves, or non-return valves, include duckbill valves, reed valves, check valve (e.g., ball check valve), umbrella valves, cross-slit valves, or any suitable valve that allows liquid flow in only one direction. The one-way valve 133 may be coupled to a backflow tube 135 via a fitting 134, which may also be referred to as a tube adapter. The fitting 134 may compensate for the width difference between the backflow tube 135 and the opening of the one-way valve 133. Thus, the fitting 134 enables the backflow tube 135, which can have a smaller width than the opening of the one-way valve 133, to be coupled to the one-way valve 133.

Although the backflow tube 135 is depicted, some embodiments of the liquid control tool can omit the backflow tube 135. A benefit of the backflow tube 135 may be to maintain a minimum amount of liquid within the cavity 138. For example, when the backflow tube 135 is absent, a user can transfer an amount of liquid into an empty cavity 138 using the one-way valve 132 before some of that amount begins to exit through the one-way valve 133. By adding the backflow tube 135, the minimum amount of liquid that is suctioned and kept in the cavity 138 before being expelled from the one-way valve 133 is greater than when the backflow tube 135 is absent. In some embodiments, the backflow tube 135 may be a curved tube. A benefit of a curved backflow tube may be to source liquid from an area of the cavity 138 that may otherwise be difficult to reach without the curved tube. For example, as the user consumes the liquid and the amount of liquid within the cavity 138 decreases, a straight backflow tube may be unable to reach liquid that is contacting the side of the cavity 138 but not contacting the opening of the straight backflow tube. A curved backflow tube 138 may contact the side of the cavity 138, as depicted in FIG. 1E.

The one-way valves 132 and 133 are coupled to receptacles 130 and 131, respectively. The receptacles 130 and 131 may be attached or built into the head 120. The one-way valves 132 and 133 may be coupled to the receptacles 130 and 131 manually or by a machine that can apply force to snap the one-way valves 132 and 133 into the receptacles 130 and 131. The receptacles 130 and 131 have an opening to enable liquid flow between the one-way valves 132 and 133 and the channels 136 and 137. Liquid flow from outside the liquid control tool 100 into the cavity 138 begins at the opening 122, flows through the channel 136, and flows out of the one-way valve 132, held in place by the receptacle 130, into the cavity 138. Liquid flow from inside the cavity 138 into the bowl 123 begins at the backflow tube 135, through the one-way valve 133, held in place by the receptacle 131, through the channel 137, and into the bowl 123.

The head 120 also includes an attachment interface 150 that couples the handle 110 to the head 120. The attachment interface 150 includes a ring-shaped cavity 151. The ring-shaped cavity 151 has a width and a depth to receive the rim of the handle 110. The width of the ring-shaped cavity 151 may be equal or substantially equal to the width of the handle 110. For example, the rim of the handle 110 can be one millimeter thick and the width of the ring-shaped cavity 151 may be approximately 0.9 mm to receive and maintain attachment with the rim after a user has applied force to insert the rim into the ring-shaped cavity 151 of the attachment interface 150. Thus, when the user connects the head 120 to the handle 110, the opening 140 of the cavity 138 is sealed by the attachment interface 150 and the liquid in the handle's cavity 138 cannot escape from the cavity 138 other than to exit through the one-way valve 133 out to the bowl 123. The depth of the ring-shaped cavity 151 can be at least one millimeter and less than a quarter of a length of the handle 110.

The liquid control tool 100 can be separated into different components for pouring a liquid directly into the tool or for cleaning the tool. For example, the handle 110 is detachable from the head 120 to enable a user to pour a liquid directly into the cavity 138 through the opening 140. In another example, the one-way valves 132 and 133 are detachable from the receptacles 130 and 131, respectively, so that the one-way valves and receptacles may be cleaned. Similarly, the one-way valve 133, the fitting 134, and the backflow tube 135 may be detachable from one another so that the components may be cleaned.

Liquid Control Tool Operation

Figure 2:
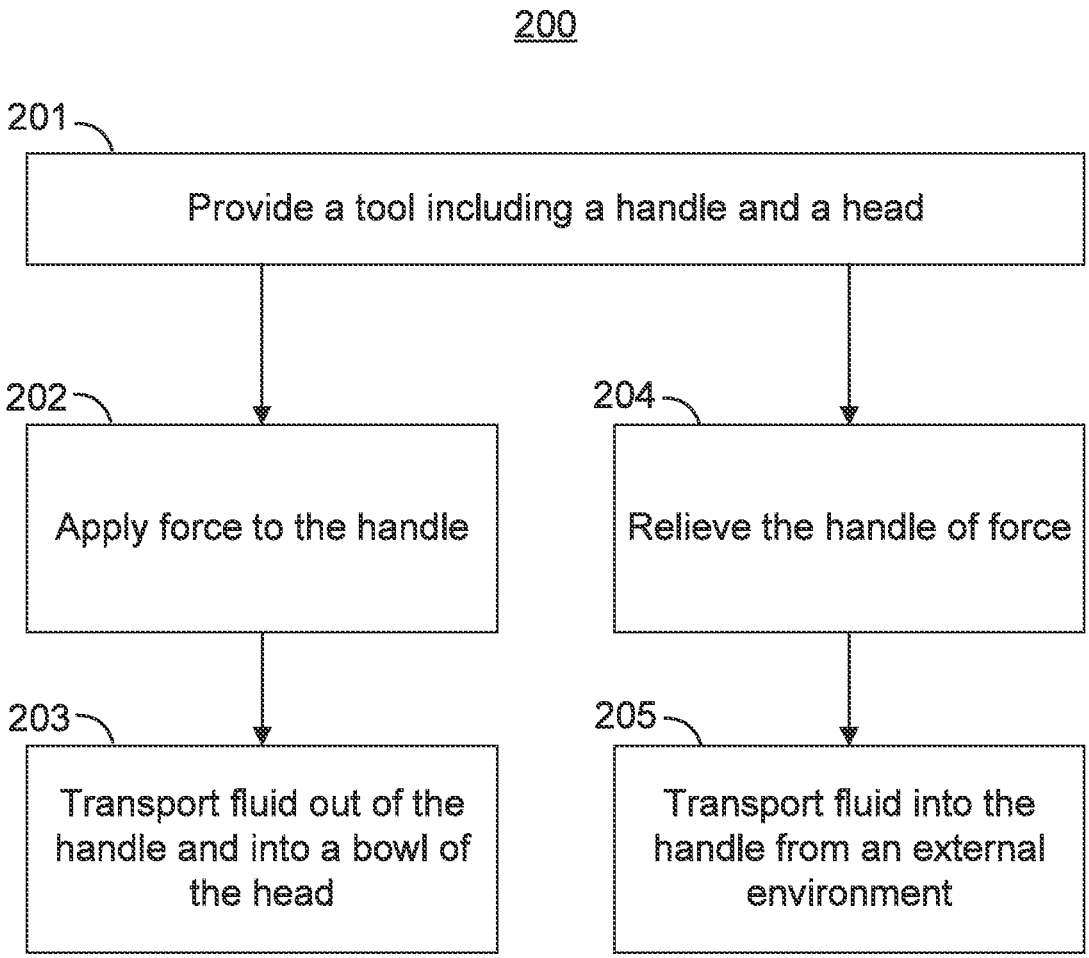
FIG. 2 is a flowchart depicting a process for operating a liquid control tool, in accordance with one embodiment.

The liquid control tool described herein can be used to transport fluid. FIG. 2 is a flowchart depicting a process 200 for operating the liquid control tool 100. The tool 100 is provided 201 with the user handling the liquid control tool 100 at the handle 110. The user applies 202 force to the handle 110 and consequently, transports 203 contents out of the handle 110 (e.g., out of the cavity 138 within the handle 110) and into the bowl 123 of the head 120. When the user relieves 204 the handle 110 of the applied force, the user transports 205 content into the handle 110 from an environment external to the tool 100.

The liquid control tool 100 of FIGS. 1A-1G is shown in a primary state having an absence of liquid within the handle 110. The process 200 can be applied to change the state of the liquid control tool 100 to a secondary state having liquid within the handle 110. The user, who is provided 201 the tool 100, can apply 202 force to the handle to expel air from the cavity 138. Because fluid is absent from the handle 110 in the primary state, fluid is not yet transported out of the handle 110 in response to the application 202 of the force. The user can submerge the opening 122 of the head 120 into liquid and relieve 204 the handle 110 of the applied 202 force. In response to relieving 204 the handle 110 of the force, liquid is transported 205 from the opening 122 and into the cavity 138. The user may repeat squeezing and releasing the handle to fill the cavity 138 with an amount of liquid, where the backflow tube 135 enables a minimum amount of liquid to be filled in the cavity 138 before applying 202 force to the handle 110 causes the stored liquid to be expelled through the one-way valve 131. When the liquid amount within the cavity 138 has contacted the opening of the backflow tube 135 while the user is applying 202 force to the handle 110, the liquid may be transported 203 out of the handle 110 and into the bowl 123. Accordingly, the process 200 can be used to fill the liquid control tool 100 with liquid and subsequently expel the liquid (e.g., for consumption).

Liquid Control Tool Manufacture

In one embodiment, a non-transitory computer readable medium stores instructions that, when executed by a computer system, cause the computer system to perform a process for manufacturing a liquid control tool. The computer system may be enabled to receive the instructions for manufacturing the tool. The computer system may instruct a machine to fabricate the tool. In one example, the machine is a 3D printer or any suitable additive manufacturing machine. In another example, the machine is a non-additive manufacturing machine that uses techniques such as injection molding or machining, where the operations of the machine may be realized upon the execution of instructions stored on non-transitory computer readable medium.

ADDITIONAL CONSIDERATIONS

Throughout this specification, plural instances may implement components, operations, or structures described as a single instance. Although individual operations of one or more methods are illustrated and described as separate operations, one or more of the individual operations may be performed concurrently, and nothing requires that the operations be performed in the order illustrated. Structures and functionality presented as separate components in example configurations may be implemented as a combined structure or component. Similarly, structures and functionality presented as a single component may be implemented as separate components. These and other variations, modifications, additions, and improvements fall within the scope of the subject matter herein.

As used herein any reference to "one embodiment" or "an embodiment" means that a particular element, feature, structure, or characteristic described in connection with the embodiment is included in at least one embodiment. The appearances of the phrase "in one embodiment" in various places in the specification are not necessarily all referring to the same embodiment.

Where values are described as "approximate" or "substantially" (or their derivatives), such values should be construed as accurate +/−10% unless another meaning is apparent from the context. From example, "approximately ten" should be understood to mean "in a range from nine to eleven."

Some embodiments may be described using the expression "coupled" and "connected" along with their derivatives. It should be understood that these terms are not intended as synonyms for each other. For example, some embodiments may be described using the term "connected" to indicate that two or more elements are in direct physical or electrical contact with each other. In another example, some embodiments may be described using the term "coupled" to indicate that two or more elements are in direct physical or electrical contact. The term "coupled," however, may also mean that two or more elements are not in direct contact with each other, but yet still co-operate or interact with each other. The embodiments are not limited in this context.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

In addition, use of the "a" or "an" are employed to describe elements and components of the embodiments herein. This is done merely for convenience and to give a general sense of the invention. This description should be read to include one or at least one and the singular also includes the plural unless it is obvious that it is meant otherwise.

While particular embodiments and applications have been illustrated and described, it is to be understood that the disclosed embodiments are not limited to the precise construction and components disclosed herein. Various modifications, changes and variations, which will be apparent to those skilled in the art, may be made in the arrangement, operation and details of the method and apparatus disclosed herein without departing from the spirit and scope defined in the appended claims.

What is claimed is:

1. A spoon comprising:
- a handle having a cavity;
- a head attached to the handle, the head having a concave surface defining a bowl;
- a first one-way valve configured to allow fluid to transfer, through a first opening in the bowl, from an external environment into the cavity; and
- a second one-way valve configured to allow fluid to transfer, through a second opening in the bowl, from the cavity into the bowl.

2. The spoon of claim 1, wherein the head further has a convex surface and the first opening is in the convex surface.

3. The spoon of claim 1, wherein the second opening is in the concave surface.

4. The spoon of claim 1, wherein the head further has:
- a first channel coupling the first opening to the first one-way valve; and
- a second channel coupling the second opening to the second one-way valve.

5. The spoon of claim 4, wherein the head further includes:
- a first receptacle configured to couple the first one-way valve to the head; and
- a second receptable configured to couple the second one-way valve to the head.

6. The spoon of claim 1, further comprising a backflow tube coupled to the second one-way valve, the backflow tube enabling an initial amount of fluid to be stored in the cavity before being transferred from the second one-way valve to the bowl.

7. The spoon of claim 6, wherein the backflow tube is coupled to the second one-way valve using a fitting.

8. The spoon of claim 6, wherein the backflow tube is curved.

9. The spoon of claim 1, wherein the head further has an attachment interface attaching the head to the handle, the attachment interface including a ring-shaped cavity having a width and a depth to receive a rim of the handle.

10. The spoon of claim 9, wherein the opening of the cavity is sealed by the attachment interface when the head is attached to the handle.

11. The spoon of claim 9, wherein the width of the rim is equal to a width of the handle.

12. The spoon of claim 9, wherein the depth of the ring-shaped cavity is at least one millimeter and less than a quarter of a length of the handle.

13. The spoon of claim 10, wherein the first one-way valve and the second one-way valve are coupled to the attachment interface and encircled by the ring-shaped cavity.

14. The spoon of claim 1, wherein the handle comprises a non-opaque material.

15. The spoon of claim 1, wherein the handle comprises a flexible material.

* * * * *